United States Patent [19]

Minerd et al.

[11] Patent Number: 5,044,964

[45] Date of Patent: Sep. 3, 1991

[54] PROGRAMMABLE CONNECTOR MODULE

[75] Inventors: Timothy M. Minerd, Pittsford; Larry R. Barnard, Rochester; Lawrence P. Lavery, Fairport; Ross E. Schroll, East Rochester, all of N.Y.

[73] Assignee: Xerox Corporation, Stamford, Conn.

[21] Appl. No.: 559,241

[22] Filed: Jul. 30, 1990

[51] Int. Cl.[5] ..... H01R 9/07

[52] U.S. Cl. ..... 439/67; 439/498; 439/516; 439/925

[58] Field of Search ..... 439/68–73, 439/43, 49, 52, 189, 516, 67, 77, 492, 493, 498, 535, 925, 67

[56] References Cited

U.S. PATENT DOCUMENTS

| | | | |
|---|---|---|---|
| 3,594,684 | 7/1971 | Miller et al. | 439/67 |
| 3,818,279 | 6/1974 | Seeger, Jr. et al. | 361/398 |
| 4,089,041 | 5/1978 | Lockard | 439/49 |
| 4,090,667 | 5/1978 | Crimmins | 439/516 |
| 4,169,647 | 10/1979 | Knowles et al. | 439/405 |
| 4,471,158 | 9/1984 | Roberts | 439/516 |
| 4,508,399 | 4/1985 | Dowling et al. | 439/67 |
| 4,564,256 | 1/1986 | Damiano et al. | 439/404 |
| 4,609,241 | 9/1986 | Peterson | 439/85 |
| 4,762,506 | 8/1988 | Thompson et al. | 439/418 |
| 4,764,122 | 8/1988 | Sorel et al. | 439/66 |
| 4,932,873 | 6/1990 | La Shier | 439/76 |

*Primary Examiner*—Neil Abrams
*Attorney, Agent, or Firm*—Oliff & Berridge

[57] ABSTRACT

A programmable connector module is equipped with a molded plastic base on which an IC chip is mounted. The plastic base is wired with programmable inputs which can be used to provide a logic 1 or a logic 0 to each input of the IC chip. Tabs or punch holes located on the plastic base can be broken to disconnect an input circuit from ground to allow a logic 1 to be programmed. Two inputs are used to program the configuration of the module and four inputs are used to program the address of the module. The programmable module can be positioned anywhere along a multiplex wire bus and is equipped with connectors for transmitting and receiving data to and from electrical loads along the bus.

14 Claims, 6 Drawing Sheets

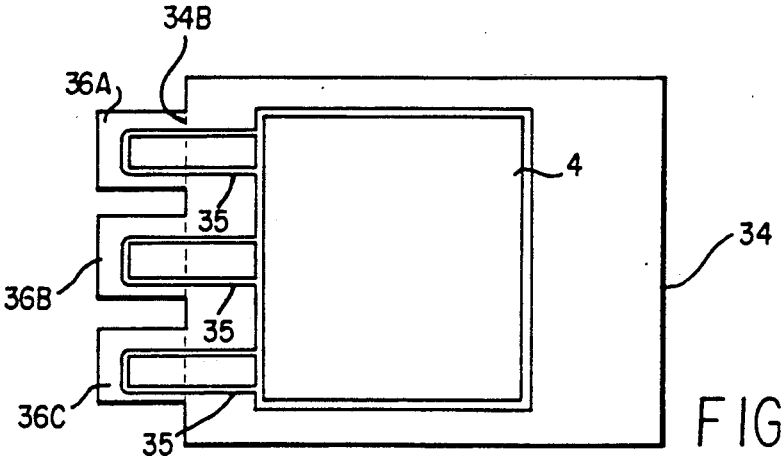
FIG. 2
FIG. 4A
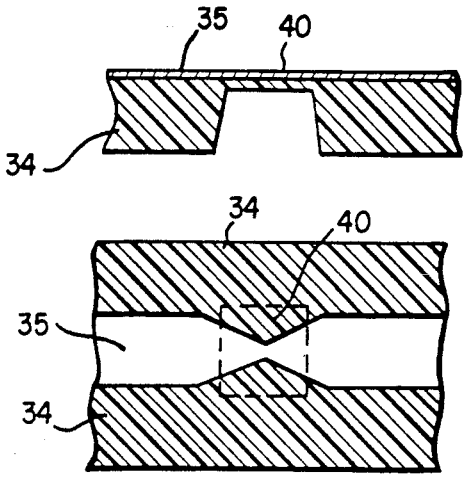
FIG. 4B
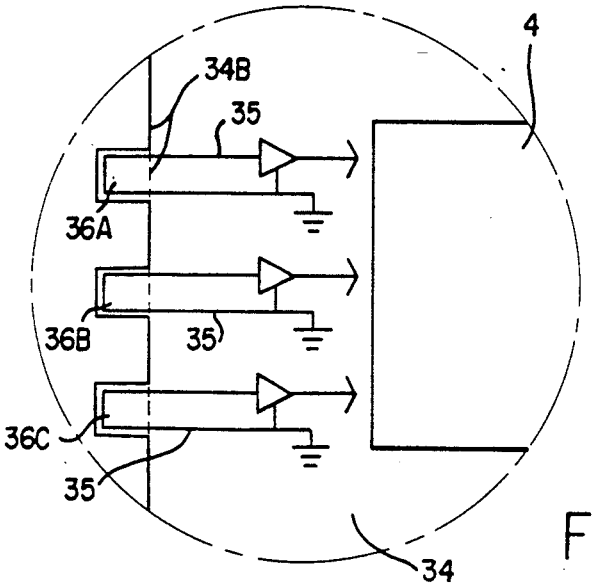
FIG. 3

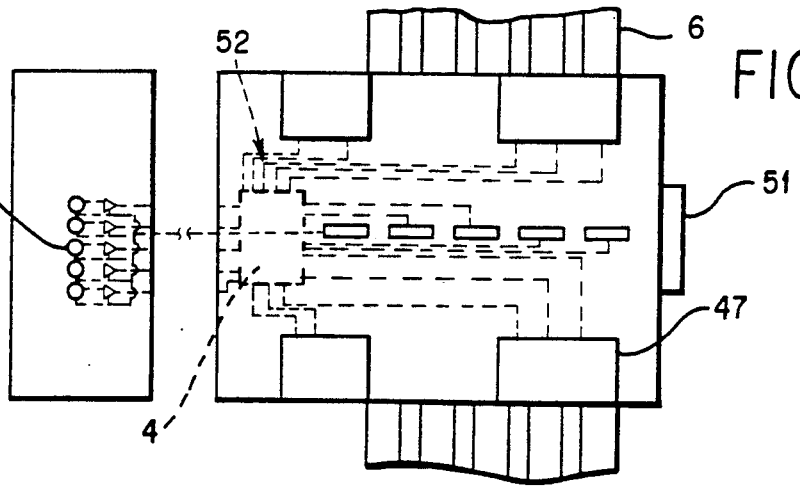
FIG. 6A
FIG. 6B
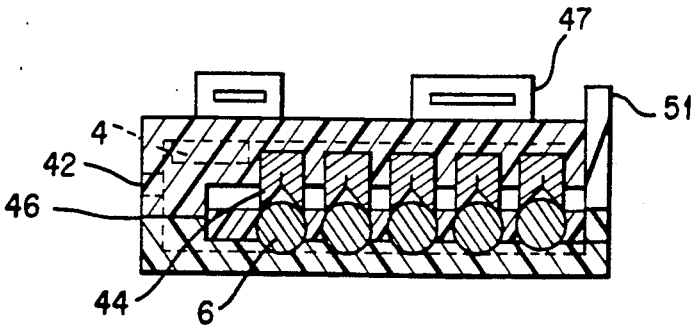
FIG. 6C

PROGRAMMABLE CONNECTOR MODULE

CROSS REFERENCES

The present application is one of a series of copending applications containing related technical subject matter. The related applications are U.S. Ser. No. 07/625,095 filed Dec. 10, 1990; and U.S. Ser. No. 07/560,811 filed July 31, 1990.

BACKGROUND OF THE INVENTION

1. Field of the Invention

The present invention pertains to connector modules and more particularly to connector modules which can be mechanically programmed to carry power and control logic to selected sensing and control devices along a multi-wire bus of an electrical-mechanical device.

2. Description of Related Art

In typical electrical-mechanical devices, hundreds of wires can be necessary to electrically connect electrical loads, e.g. motors, solenoids, sensors, switches, etc., with a control mechanism. Prior art devices have attempted to address this problem through various programming methods and module designs.

U.S. Pat. No. 4,471,158 to Roberts discloses a programmable header constructed from an integral lamina circuit which contains a plurality of electrical pins that project outwardly from an insulated housing. Programming of the connector is achieved by an interconnection of the electrical pins. U.S. Pat. No. 4,089,041 to Lockard discloses a programmable circuit device wherein a plurality of strap conductors, mounted onto a dielectric substrate, form connections between leads extending from a connector housing. The device may be programmed by selectively punching out strap conductors from electrical terminals to thereby interrupt the electrical continuity within the device and thus define specific circuit paths. U.S. Pat. No. 4,090,667 to Crimmins discloses a programmable shorting plug for an integrated circuit socket having a housing which contains a plurality of exposed terminal pins which may be electrically shorted by electrical conductive bridges to define a desired programming configuration.

U.S. Pat. No. 4,508,399 to Dowling et al discloses a multi-stage ribbon cable connector wherein two flat cables may be connected to a logic circuit chip interface which is mounted within an intermediate stage of a connector. The logic circuit chip and a flat cable may be electrically connected by coupling the conductive terminals located within the connector housing and the ribbon cable, respectively. The logic chip is used to traffic electrical communication between the ribbon cables via a parallel bus-type configuration. U.S. Pat. No. 4,764,122 to Sorel et al discloses a data bus connector having a plurality of substrates which are fastened one on top of the other in a parallel level configuration that is intended for connection onto a printed circuit board. Each substrate level possesses a series of conductive pins whereon an active circuit or integrated circuit chip may be mounted.

U.S. Pat. No. 3,594,684 to Miller discloses an electrical interconnection module wherein layers of electrical circuitry, located on different stages of the module, are electrically connected within a multi-layer electrical assembly where each layer or substrate can accommodate integrated circuits or other active or passive components. A plurality of conductive tabs located on each substrate provide electrical contact and communication between stages within the module.

U.S. Pat. No. 4,762,506 to Thompson et al discloses a connection cable assembly wherein an integrated circuit dual-in-line package (DIP) device, plugged directly into the connector housing can be electrically connected with signals traveling along a multi-conductor ribbon cable. U.S. Pat. No. 3,818,279 to Seeger, Jr. et al discloses an electrical interconnection and contacting system having a substrate made of a flexible material which connects an integrated circuit chip, mounted onto a connector housing, to another integrated circuit chip or to active circuitry on a printed circuit board. U.S. Pat. No. 4,564,256 to Damiano et al discloses a flat cable transition connector whereby an electrical connection between a flat cable and a plurality of individual wire conductors is realized. U.S. Pat. No. 4,169,647 to Knowles et al discloses an integral, low profile latch for a cable connector wherein conductive pins may be inserted into a plurality of slots to establish electrical communication between a multi-conductor cable and external circuitry.

However, none of the prior art discloses an intelligent input-output connector device which can be mechanically programmed to customize an integrated circuit chip contained in a module so as to enable the chip to receive desired addressing and input-output information, the module connecting to various low current and high current loads and converting signals from a wire bus into states for the output devices and sending back on the bus the states of the input devices.

SUMMARY OF THE INVENTION

It is an object of this invention to provide a programmable connector module which eliminates the massive amounts of interconnective wiring in conventional electromechanical driven systems for controlling a machine.

It is another object to provide a connector module equipped with a standard package integrated circuit chip which can be custom programmed at the harness level of assembly to provide desired addresses and configurations.

It is another object of the present invention to provide a programmable connector module which would allow the easy replacement of an IC chip without the need to program the replacement chip.

It is another object of the present invention to provide a mechanically programmable module which can be programmed to address selected components along a wire bus.

It is another object of the present invention to program the mechanically programmable module to a desired configuration of inputs and outputs.

It is a further object of the present invention to provide conductive traces applied to a plastic molded structure or any other suitable structure so as to electrically connect an integrated circuit (IC) chip mounted on a programmable intelligent input/output connector module with various loads of an electrical-mechanical network.

These and other objects and advantages are accomplished and realized by a programmable connector module which is used to transmit and receive data from a plurality of loads associated with an electrical-mechanical device. An integrated circuit (IC) chip is mounted upon a base which is wired to accommodate input and output signals to and from the IC chip. Programmable inputs of the IC chip are equipped with tabs or programming holes which when broken sever the connection of the input to ground. This broken connection results in a logic 1 being programmed to the IC chip. If the tabs or programming holes are not broken, the input is a logic 0.

A multi-wire bus having a serial input data line, a serial output data line, a clock line, a voltage line and a grounded line are connected to the base and the IC chip by electrical contacts. By placing modules close to appropriate loads along the multi-wire bus, the need for a multiplicity of wires and electrical connections can be eliminated. The chip takes signals from the multi-wire bus and converts the signals into states for the output devices and sends back on the bus information pertaining to the states of the input devices.

BRIEF DESCRIPTION OF THE DRAWINGS

The invention will be described in detail with reference to the following drawings, wherein:

FIG. 2 is a plan view of the connector housing, IC chip and break-away tabs in accordance with the present invention;

FIG. 3 is a schematic circuit diagram demonstrating how the various programmable inputs are programmed;

FIG. 4A is a side view showing the thinned-out section of the conductor of the connector housing and FIG. 4B is a top view of this thinned-out section;

FIG. 6A is a top view of the programmable module according to another embodiment of the present invention;

FIGS. 6B and 6C are side views of the module depicted in FIG. 6A;

FIG. 100 is a cross sectional view of the latching cover;

DETAILED DESCRIPTION OF THE PREFERRED EMBODIMENTS

Figure 1:
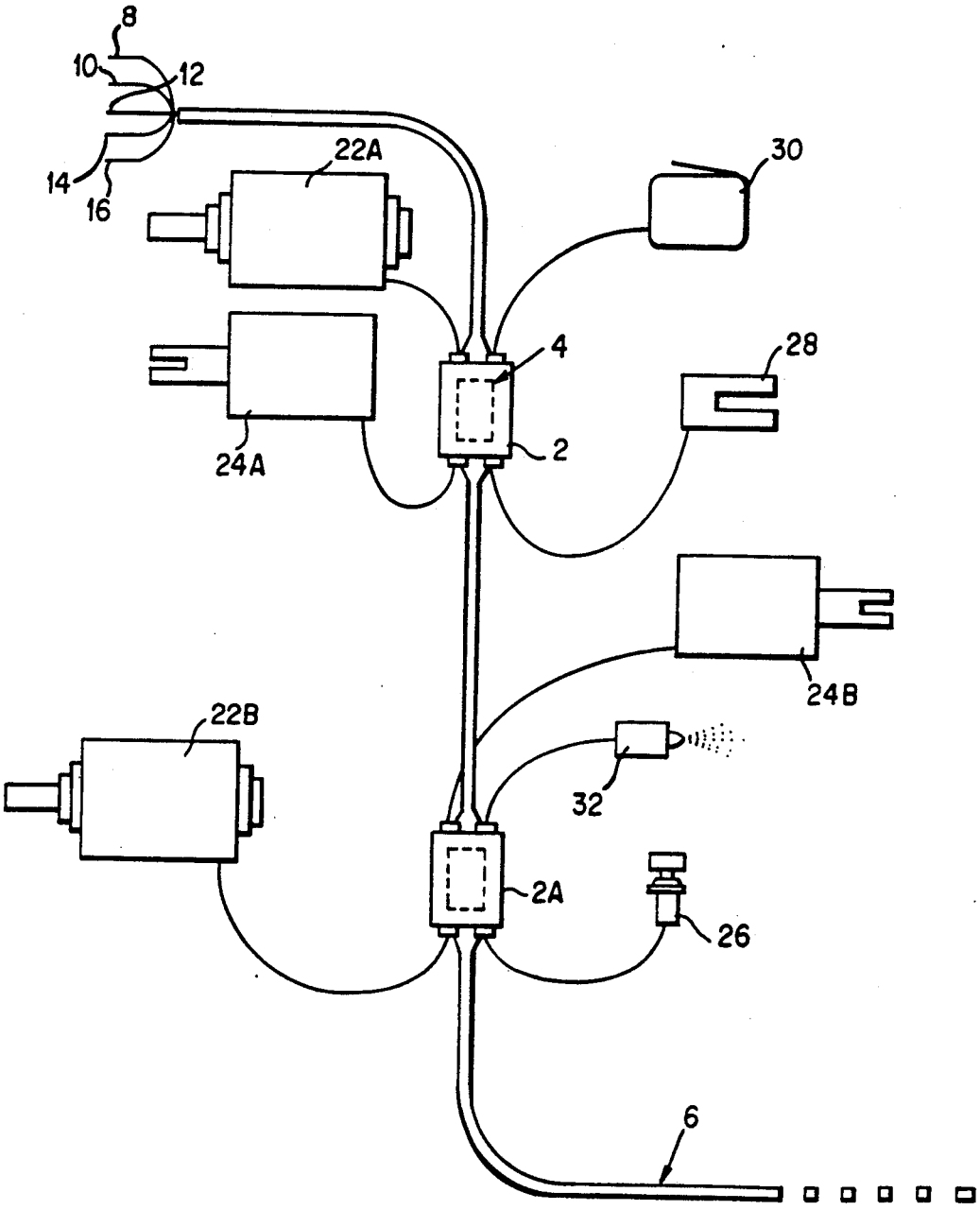
FIG. 1 is a schematic illustration showing the programmable module located along a bus line and the module interfacing with a variety of loads.

Referring now to the drawings, wherein like reference numerals designate identical or corresponding parts throughout the several views, and more particularly to FIG. 1 thereof, an IC (integrated circuit) chip 4 is affixed upon intelligent input/output connector (IIOC) module 2. A multiplex bus 6 connects the module so that modules 2 and 2A (2B, 2C, etc.) can be connected along bus 6. Bus 6 is equipped with a serial input data (SID) line 8, a serial output data (SOD) line 10, a clock (CLK) line 12, a voltage (+V) line 14, and a grounded (GND) line 16. Connected to module 2 are DC motor 22A, solenoid 24A, micro switch 30 and sensor 28. Connected to module 2A are DC motor 22B, indicator 32, solenoid 24B and push button switch 26. FIG. 1 illustrates how a number of electrical loads can be interconnected to various modules along bus line 6.

The five wires of wire bus 6 run throughout an electrical-mechanical machine (i.e. any kind of electromechanical device) and the modules are placed near appropriate loads e.g. motors, solenoids, sensors, switches, etc. By placing the module close to the load, the load can be plugged directly into the module which eliminates the large quantity of wires which are normally needed to interface with such loads. As a result of the programmable features of the present invention, bus 6 is able to selectively address each module along its length.

Figure 5A:
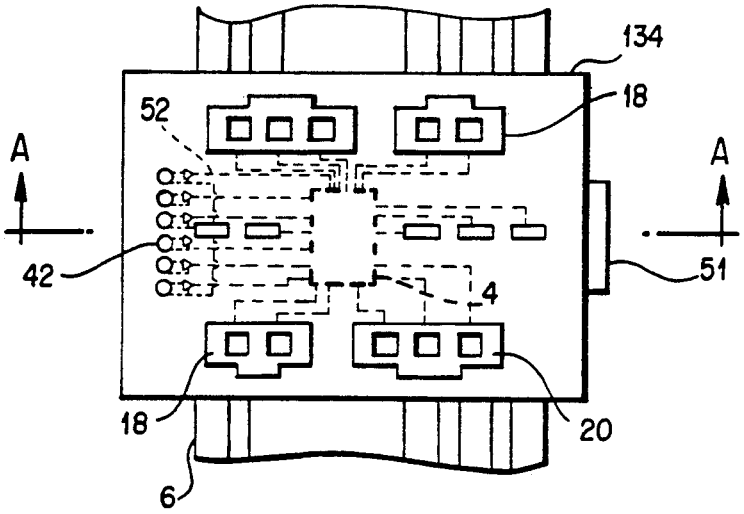
FIG. 5A is a top view of the programmable module according to one embodiment of the present invention and FIG. 5B is a cross-sectional side view taken along line A—A of FIG. 5A.

With reference to FIGS. 2 and 3, each module 2 includes a connector housing 34 on which the IC chip 4, or other active device is mounted. Connector housing 34 functions as means for mounting an IC chip 4 thereto. Conductive patterns 35 are fabricated into the connector housing 34 for each programmable input of the IC chip 4. A part of conductor pattern 35 is included on break-away tabs 36A, 36B, 36C etc. which are integral with the plastic connector housing 34. The conductor pattern is formed by either deposition, plating, or other means and connected as shown in FIG. 3. The programming of each programmable input for the IC chip 4 is accomplished by either breaking away the tabs 36A, 36B, etc., thereby breaking the return path to ground for the input signal, or, by leaving the connection intact. The tabs 36A–C are broken from connector housing 34 along breaking point 34B. Breaking the tab will result in a logic 1 input and an unbroken tab will result in a logic zero input. Breaking of the tabs is facilitated by the presence of thinned-out conductor section 40 (see FIGS. 4A and 4B) which is formed as part of connector housing 34. When using breakable tabs, the breaking points correspond to thinned-out sections 40 as shown in FIG. 5A. Instead of breakable tabs, programming may be accomplished by puncturing the thinned-out section 40 (see FIG. 4B) which lies below programming holes 42 (see FIGS. 5 and 6).

The present invention utilizes fixed input contacts (e.g., break away tabs or programming holes). FIG. 2 illustrates three break-away tabs; however, the number of tabs or programming holes will vary depending on the number of addresses and configurations desired for a particular system.

For example, if four input contacts are used to program the address of a module, then $4^2$ or 16 different addresses can be programmed. If two input contacts are used to designate a particular configuration, then $2^2$ or 4 configurations are made possible. By configuration is meant the combination of inputs and outputs controlled by a module. For example, in a first configuration, the module could be programmed to output twice and send back twice. If a system of modules located on a bus utilized 16 different address and three different configurations, then 48 different varieties of programmed modules could be located on the same bus. Accordingly, the breakaway tabs or programming holes, and more particularly, the thinned-out section 40 with the conductor patterns 35 thereon function as programming means for customizing the IC chip to a particular address and configuration.

In practice, when no tabs are broken or no holes are punctured so that all inputs have a return path to ground, address 0 and configuration 0 are indicated. By breaking one tab, address 1 and configuration 0 results. This sequence proceeds in a binary fashion. The programming of the four input address tabs or programming holes are used to set the count, i.e., the number of clock counts before the data a particular module needs to drive an output load is available on the serial input line. Thus, when the module gets the address on the count designating that particular module, the module samples the input data and then sends back output data. If the module is programmed to be a two output device, it samples twice and sends back twice. If the module is programmed to be a three input or a four output device, it will sample four pieces of data but normally sends back either one or none.

The above describes normal operation. In a second mode of operation, a diagnostics mode, the module will send back three or four pieces of data when in a 3 or 4 bit configuration. However, in a 2 bit configuration, the module sends back two pieces of data in both the normal and diagnostic modes of operation. The data sent in the diagnostic mode represents the states of the drivers enabled by the configuration programmed. The diagnostics mode is entered by sending a logic "1" on the SID line 8 during the reset time of the clock signal, i.e., when the clock line is raised to 15 volts.

Figure 5B:
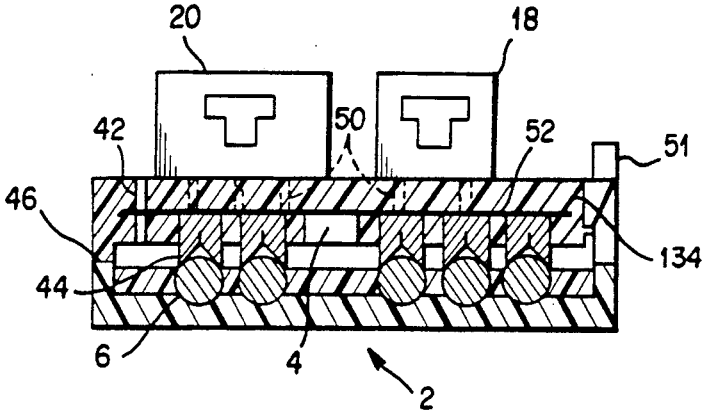

FIGS. 5A and 5B show a custom molded plastic module with insulation displacement connector (IDC) terminals 44 which snap around each wire of a ribbon cable bus 6. A living hinge 46 allows the module to be opened so that the wire bus 6 can be inserted. The IDC terminals 44 are placed in contact with the bus 6 when the module is closed and secured by latch 51. The metal insulation displacement terminals 44 pierce the insulation of the bus wires so that electrical contact is facilitated. IDC terminals are electrically connected to the input/output circuitry 52 of the module. Thus, IDC's function as connecting means for connecting IC chip 4 to the multi-wire bus 6.

Chip 4 is surface mounted to connector housing 134 which contains input/output circuitry 52. FIG. 5B shows IC chip 4 to be located directly below and in electrical contact with input/output circuitry 52. The input/output circuitry 52 connected to chip 4 would be provided with whatever active components are required. Any resistors necessitated are screen printed. Input/output circuitry 52 could be comprised of conductive traces formed on plastic or by the (MCD) method of Allen Bradley disussed below. Input/output circuitry 52 is insert molded to the hinged module shown in FIGS. 5A and 5B.

The molded plastic module and interconnecting elements can be fabricated by using molded circuit device (MCD) technology such as that being used by Allen-Bradley International Ltd. For an example of an MCD technique, U.S. Pat. No. 4,912,288 to Atkinson et al assigned to Allen-Bradley is herein incorporated by reference.

Programming holes 42 have a skin over them to visually indicate programming. With reference to FIG. 5B, holes 42 are seen to extend from the top of module 2 to a point just adjacent to where a portion of the input/output circuitry 52 which contains the conductive portions 35 for programming IC chip 4 is located. Thus, the conductive portions 35 of the input/output, circuitry 52 are located adjacent to thinned out section 40 as shown in FIG. 4A. A circular cutting tool removes the skin and severs the conductor printed on the internal interconnect film. This programming would happen at the harness stage of installation when the module is installed to the bus 6. The plastic module shown in FIG. 5A has two three-prong connectors 20 and two two-prong connectors 18.

Figure 7A:
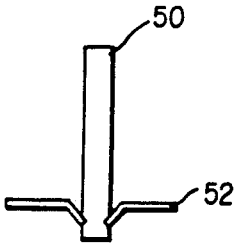
FIG. 7A is a side illustration showing how an SL PIN connects with the circuitry of the module of the present invention and FIG. 7B is a top view of the SL PIN connecting with the circuitry of the present invention.
Figure 7B:
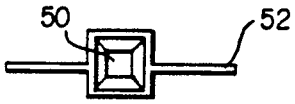

Connectors 18 and 20 are electrically connected to IC chip 4, by means of stackable linear pin 50 (SL PIN) shown in FIGS. 7A and 7B which connect connectors 18 and 20 with input/output circuitry 52. The pins 50 are secured in the connectors by conductive epoxy.

Connectors 18 and 20 connect the module 2 with various loads to the bus 6. The three-prong connectors 20 are used for sensors and low current output loads whereas the two-prong connectors 18 are reserved for high current output such as motors and solenoids. FIG. 5A shows each two-prong connector 18 being arranged opposite to a three-prong connector 20. However, the three-prong connectors 20 could be arranged opposite to each other and the two prong connectors 18 could be arranged opposite to each other as well. Accordingly, connectors 18 and 20 function as connecting means for connecting the IC chip 4 with a plurality of loads.

FIGS. 6A, 6B, 6C illustrate an embodiment of the present invention similar to that shown in FIGS. 5A and 5B, however this alternative embodiment shows programming holes 42 located on a side of the module and Molex® or AMP®-ZIF® connectors 47 with a polarized barrier in the middle being used for connectors 18 and 20. It is understood that a number of different connector mechanisms can be used to connect the IC chip 4 to various loads along a bus 6. Such mechanisms would not deviate from the underlying teachings of the present invention.

Figure 8:
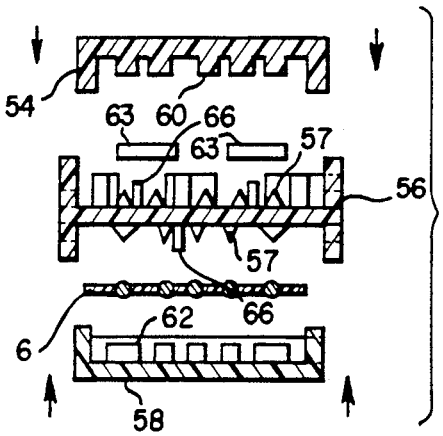
FIG. 8 is an exploded view showing a three-stage programmable module having a latching cover, plastic base and bottom cover according to another embodiment of the present invention.

FIG. 8 shows a three-stage module assembly in which a molded plastic base 56 contains electrical conductors 57 on either side of the plastic base 56. These electrical conductors (or conductive traces) 57 interconnect the plastic base to the wire bus 6 on one side and to electrical connections connecting the molded base to various electrical loads on the other side of the molded base. The latching cover 54, having spring members 60 molded in, when snap-fitted into molded plastic base 56, securely fastens input/output cables 63 (FIG. 11) to electrical contacts 64 (which are electrically connected to the conductive traces 57) on the molded base thus connecting the IC chip 4 with various electrical loads proximate to the module. The bottom cover 58, having springs 62, is likewise snap-fitted into the lower portion of molded plastic base 56 so as to secure the five-wire bus 6 with the electrical contacts 64 and thus to the electrical conductors 57 attached to the bottom of the molded base 56.

Figure 9:
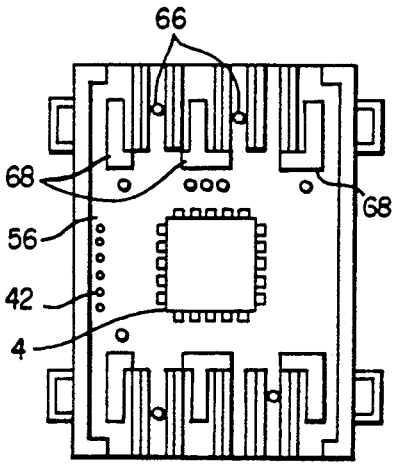
FIG. 9 is plan view of the molded plastic base according to the embodiment of the invention shown in FIG. 8.
Figures 10A, 10B, 10C, 10D:
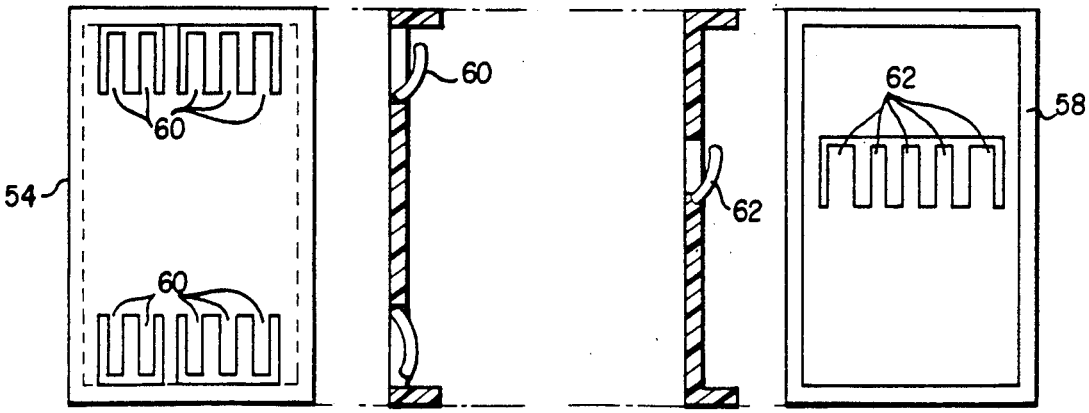
FIG. 10A illustrates the top side of the bottom cover of the embodiment shown in FIG. 8.
FIG. 10B is a cross-sectional illustration of the bottom cover of FIG. 10A.
FIG. 10C illustrates the bottom side of the latching cover of FIG. 8

FIG. 9 shows base 56 which is provided with conductive patterns (such as conductive patterns 35 and input/output circuitry 52 of housing 34 in FIG. 2) for interfacing with IC chip 4. Base 56 is further provided with programmable holes 42 and conductive traces 57 on its top and bottom surfaces for making electrical contact with the bus 6 and input/output cables 63. FIGS. 10A and 10B illustrate the bottom cover 58 and how the springs 62 are situated in the bottom cover. FIGS. 10C and 10D illustrate latching cover 54 and how springs 60 are situated in the latching cover.

Figure 11:
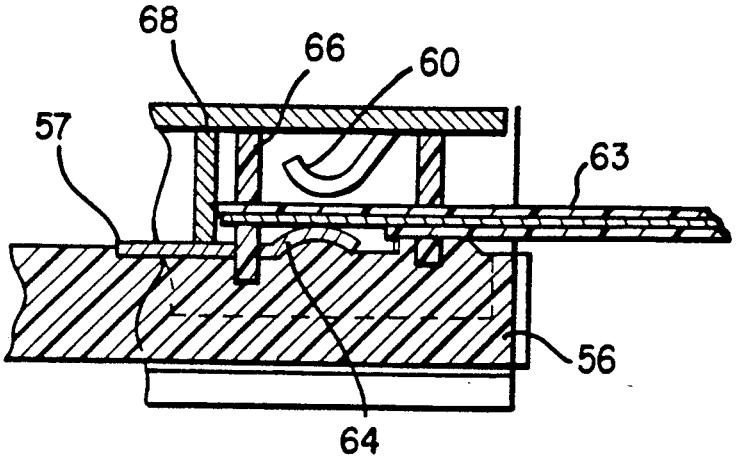
FIG. 11 is a schematic cross-sectional illustration showing a side view of the embodiment shown in FIG. 8.
Figure 12:
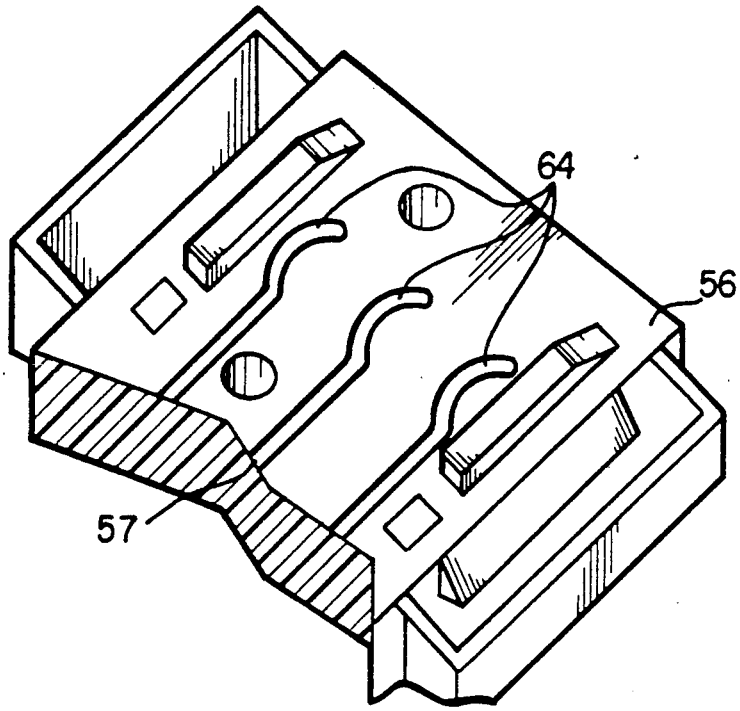
FIG. 12 is a perspective illustration of the conductive traces on the plastic base portion of the three-stage module according to the interconnective concept depicted in FIG. 11.

FIGS. 11 and 12 illustrate plastic base 56 having conductive traces 57 and electrical contacts 64 which connect to input/output cables 63. Polarizer 66 is inserted in a hole in the flat ribbon input/output cable 63 to insure that the cable is properly oriented and arranged in the proper position and that the intended side of the cable makes contact with the conductive traces of base 56. The cable stop 68 prevents any further axial movement of cable 63. Spring 60 further secures the cable 63 to base 56 by pressing the cable to the electrical contacts 64 of the conductive traces 57 when the module is latched or snapped together.

Figure 13:
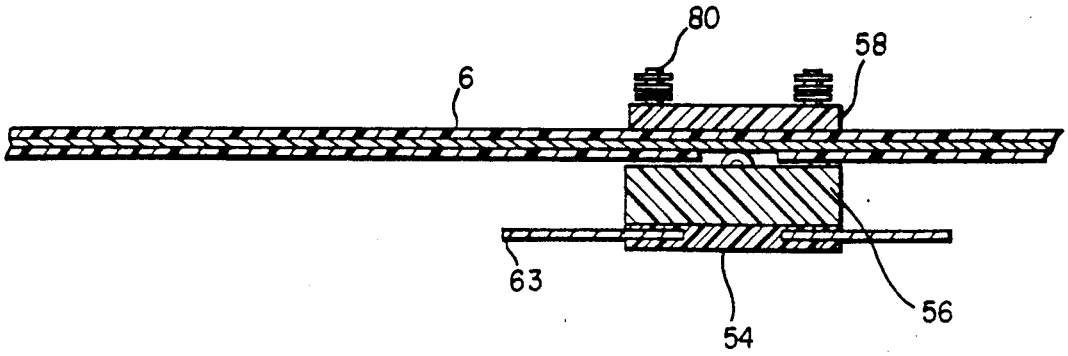
FIG. 13 is a schematic illustration demonstrating how a three-stage connector module can be panel mounted.

FIG. 13 shows a three-stage module in which a bottom cover 58 is provided with xmas tree fasteners 80 for attaching the module to panel mountings in an electrical-mechanical device.

In that every harness assembly is unique because of its length, the present invention allows the use of any number of modules along the length of a bus. The invention allows each module to be custom programmed to a desired address and configuration while utilizing a minimum of wiring. Furthermore, the modules disclosed permit easy testability (diagnostic mode) to ensure there is continuity along the system connected to the bus line.

The foregoing detailed description is intended to be illustrative and not limiting. Many modifications and variations are apparent from the foregoing description of the invention and all such modifications and variations are intended to be within the scope of the present invention as defined in the following claims.

What is claimed is:

1. A programmable connector module for transmitting data between a multi-wire bus and a plurality of loads comprising:

a molded plastic base having first and second oppositely facing surfaces, said second surface having contacts attachable to an IC chip thereon, said plastic base including a thinned-out section wherein a distance between said first and second surfaces is reduced so as to be frangible, said thinned-out section forming an indentation on said first surface;

first connecting means, located on one of said first and second surfaces, for electrically connecting to a plurality of wires in a multi-wire bus;

second connecting means, located on the opposite one of said first and second surfaces from said first connecting means, for electrically connecting to at least one electrical load;

the one of said first and second connecting means which is located on said first surface including electrical connections which extend through said plastic base from said first surface to said second surface;

input/output circuitry located on said second surface and attaching said first and second connecting means to said contacts, said input/output circuitry including a plurality of conductive portions which extend over said thinned-out sections and which also connect to some of said contacts, wherein said conductive portions can be selectively broken so as to program an IC chip mounted on said contacts.

2. The module of claim 1, wherein said thinned-out section is a plurality of cylindrical recesses formed in said first surface and extending toward said second surface, each of said conductive portions being located on said second surface over a corresponding one of said cylindrical recesses.

3. The module of claim 1, wherein said plastic base includes a plurality of tabs which extend outwardly therefrom, each of said conductive portions being located on a corresponding one of said tabs, with said thinned-out section being located between each of said tabs and said plastic base, wherein said tabs are breakable away from said plastic base to program the IC chip.

4. The module of claim 1, wherein said input/output circuitry is conductive traces unitarily formed with said plastic base.

5. The module of claim 1, further comprising:

a cover, lockingly engageable with said plastic base, for pressing and engaging the wires of the bus with said first connecting means.

6. The module of claim 5, wherein an edge of said cover is unitarily attached to said plastic base by a living hinge, an opposite edge of said cover including a latch engageable with said plastic base for locking said cover thereto.

7. The module of claim 5, wherein said cover includes a plurality of spring member son an engaging surface thereof which engages the bus, said spring members corresponding in number to said plurality of bus wires and arranged on said engaging surface to individually engage a corresponding one of the bus wires for pressing the bus wires against said first connecting means.

8. The module of claim 7, wherein said first connecting means is a plurality of insulation displacement connectors.

9. The module of claim 5, further comprising:

a second cover for pressing and engaging wires of load connectors with said second connecting means.

10. The module of claim 9, wherein said second cover includes a plurality of spring members located on an engaging surface thereof which engages the load connectors, said spring members corresponding in number to a number of wires contained in the load connectors, and arranged on said engaging surface to individually engage a corresponding one of the load connector wires for pressing the load connector wires against said second connecting means.

11. The module of claim 1, wherein said electrical connectors which extend through said plastic base are stackable linear pins secured in apertures in said plastic base by conductive epoxy.

12. A programmable connector module for transmitting data between a multi-wire bus and a plurality of loads comprising:

a molded plastic base having first and second oppositely facing surfaces, said second surface having contacts attachable to an IC chip thereon;

first connecting means located on one of said first and second surfaces, for electrically connecting to a plurality of wires in a multi-wire bus;

second connecting means, located on the opposite one of said first and second surfaces from said first connecting means, for electrically connecting to a plurality of electrical loads;

the one of said first and second connecting means which is located on said first surface including electrical connections which extend through said plastic base from said first surface to said second surface;

input/output circuitry located on said second surface and attaching said first and second connecting means to said contacts, said input/output circuitry including a plurality of conductive portions which also connect to some of said contacts, said conductive portions being selectively severable to program an IC chip mounted on said contacts, said input/output circuitry being conductive traces unitarily formed with said plastic base.

13. The module of claim 12, further comprising:

a cover, lockingly engageable with said plastic base, for pressing and engaging the wires of the bus with said first connecting means.

14. The module of claim 13, wherein an edge of said cover is unitarily attached to said plastic base by a living hinge, an opposite edge of said cover including a latch engageable with said plastic bore for locking said cover thereto.

* * * * *